US006310310B1

(12) United States Patent
Wristen

(10) Patent No.: US 6,310,310 B1
(45) Date of Patent: Oct. 30, 2001

(54) ENCAPSULATED VACUUM INTERRUPTER MODULE REMOVABLY MOUNTED IN A HOUSING

(75) Inventor: Cecil C. Wristen, Hudson, OH (US)

(73) Assignee: Vacuum Electric Switch Co., Hudson, OH (US)

( * ) Notice: Subject to any disclaimer, the term of this patent is extended or adjusted under 35 U.S.C. 154(b) by 0 days.

(21) Appl. No.: 09/686,182

(22) Filed: Oct. 11, 2000

Related U.S. Application Data

(63) Continuation of application No. 09/433,533, filed on Nov. 3, 1999, now Pat. No. 6,172,317.

(51) Int. Cl.[7] ..... H01H 33/662

(52) U.S. Cl. ..... 218/121; 218/135; 218/138; 218/139; 218/155

(58) Field of Search ..... 218/118, 134, 218/135, 136, 137, 138, 139, 140, 119–133, 155–158

(56) References Cited

U.S. PATENT DOCUMENTS

| | | | | |
|---|---|---|---|---|
| 3,166,658 | * | 1/1965 | Jennings | 218/138 |
| 4,527,028 | | 7/1985 | Luehring | 218/119 |
| 4,568,804 | | 2/1986 | Luehring | 218/138 |
| 4,910,367 | | 3/1990 | Akers et al. | 218/57 |
| 5,091,615 | * | 2/1992 | Lippi et al. | 218/138 |
| 5,387,771 | | 2/1995 | Luehring | 218/129 |
| 5,597,992 | * | 1/1997 | Walker | 218/121 |
| 5,912,604 | * | 6/1999 | Harvey et al. | 218/138 X |
| 6,130,394 | * | 10/2000 | Hogl | 218/138 |
| 6,172,317 | * | 1/2001 | Wristen | 218/138 |

OTHER PUBLICATIONS

Joslyn Hi–Voltage Corporation, *Transmaster Electric Furnace Switch*, pp. 1–6, Jun. 1994.

Luehring, Polyurethane Foam Insulation In Line Interrupters, Proceedings of the Seventh Electrical Insulation Conference, pp. 112–115, Oct. 1967.

* cited by examiner

*Primary Examiner*—J. R. Scott
(74) *Attorney, Agent, or Firm*—Renner, Kenner, Greive, Bobak, Taylor & Weber

(57) ABSTRACT

A high voltage electric switch includes an insulated housing with an opening therethrough and an interior surface. The housing has an upper open end and a lower open end. A conductive upper terminal pad has a downwardly extending bar, wherein the upper terminal pad encloses the upper open end. A vacuum interrupter has a stationary stem that is electrically connected to the bar, and a moving stem extending in a direction opposite the stationary stem. A dielectric material is permanently bonded to at least a portion of the vacuum interrupter and substantially fills any voids between the vacuum interrupter and the interior surface. The dielectric material and the vacuum interrupter are selectively removable from the housing when the upper terminal pad is removed. A moving end assembly is connected to the moving stem and includes a highly conductive outer sleeve which receives a high strength inner sleeve having a cross-hole therethrough. A flexible shunt assembly is connected to the outer sleeve with a conductive lower terminal pad substantially enclosing the lower open end. The lower terminal pad has an opening therethrough to allow access to the flexible shunt connected to the lower terminal pad. A pull rod axially extends through the lower terminal pad opening, wherein the pull rod is connected to a pin with a cross-pin slot. The pin is connected to the inner sleeve by a cross-pin received through the cross-hole and the cross-pin slot. An over-travel spring received within the inner sleeve and biasing the slotted pin attached to the pull rod. Axial movement of the pull rod axially moves the moving stem to connect or disconnect with the stationary stem within the vacuum interrupter.

12 Claims, 8 Drawing Sheets

ENCAPSULATED VACUUM INTERRUPTER MODULE REMOVABLY MOUNTED IN A HOUSING

CROSS REFERENCE TO RELATED APPLICATION

This is a continuation of patent application Ser. No. 09/433,533, filed Nov. 3, 1999, entitled "Encapsulated Vacuum Interrupter Module Removably Mounted In A Housing, now U.S. Pat. No. 6,172,317 B1."

TECHNICAL FIELD

This invention relates to high-voltage vacuum interrupter modules. More particularly, this invention relates to switches with vacuum interrupter modules used in electric furnaces and electric utility switching systems. Specifically, this invention relates to refurbished vacuum interrupter modules with improved operating characteristics over the original manufactured modules.

BACKGROUND ART

A high-voltage switch may include a vacuum interrupter module which performs the operation of current interruption. As is well known in the art, electric furnaces require large amounts of power to be under constant control. To properly maintain this control, the switch must be able to withstand repeated interrupting of contact at voltages of up to 138 kV.

An exemplary high-voltage vacuum interrupter module of the prior art is shown in FIG. 1 and generally indicated by the numeral 10. The module 10 includes an upper terminal pad 12 that provides an electrical and mechanical connection to the furnace or other piece of equipment operating at high voltage. The upper terminal pad 12 is electrically connected to a vacuum interrupter, generally indicated by the numeral 14, through a stationary stem 18. The vacuum interrupter 14 includes a vacuum container 20 through which axially extends the stationary stem 18 that is electrically connected to a stationary contact 24. The stationary contact 24 is mateable with a moving contact 26. FIG. 1 shows the contacts 24 and 26 in a closed circuit condition. As those skilled in the art will appreciate, the moving contact 26 connects to and is mated with the stationary contact 24 to complete the current path to the furnace or the like. The moving contact 26 and the stationary contact 24 are sealed within the highly evacuated vacuum container 20. The moving contact 26 is connected to a moving stem 32 that axially extends from the vacuum container 20. Attached to the moving stem 32 is a shunt plate 58. A flexible shunt 34 is connected to the shunt plate 58 and connected at its opposite end to a lower terminal pad 38. The module 10 is part of a switching mechanism that may include any number of modules.

A cylindrical, hollow housing, which is generally indicated by the numeral 40, along with the upper terminal pad 12 and the lower terminal pad 38, enclose the vacuum interrupter 14 and the flexible shunt 34. The terminal pad 38 may provide circular grooves that receive O-rings to preclude entry of moisture into the housing 40.

A bellows 41 is incorporated between the moving stem 32 and the proximal end of the vacuum container 20. The bellows 41 is a very thin flexible metal that allows the contacts 24 and 26 to separate while still maintaining the very high vacuum inside the vacuum container 20. External air pressure acting on the bellows 41 exerts a force on the moving stem 32 which is proportional to the diameter of the bellows. This external air pressure force has to be overcome by the switch mechanism during the opening of the module 10. Thus, sizing of the bellows 41 is critical. A dielectric material 42 is interposed and bonded to the housing 40 and the vacuum interrupter 14 to preclude any electrical flashover caused by system transients.

In operation, when the module 10 changes from a closed to an open state, an external lever mechanism moves the moving stem 32 by an insulated pull rod 44 through a pull rod screw 57. The pull rod 44 axially withdraws the pull rod screw, which is mechanically and electrically attached to the moving contact 26 inside the vacuum interrupter 14, and separates the contacts 24 and 26 from one another a small amount. Movement of the pull rod screw is biased by the flexible shunt 34. At the moment of separation, metal in the contacts 24 and 26 is vaporized and forms a conductive plasma. The current continues flowing through this plasma until a current zero is reached. At the current zero, metal vapors are no longer generated at the surfaces of the contacts 24 and 26. As such, the conductive plasma dissipates, and when the next alternating current cycle occurs, no current flows because there is no conductive material in the gap between the contacts.

Closing of the module 10 initiates a reverse sequence of the above operation. The external lever mechanism pushes on the pull rod 44 which pushes on the pull rod screw which in turn pushes on an over-travel spring 46 contained within the moving stem 32. Axial movement of the moving stem 32 axially moves the moving contact 26. Accordingly, the contacts 24 and 26 are connected and the vacuum interrupter module 10 is closed. The spring 46 functions to equalize the force among several vacuum interrupter modules simultaneously operated by the same external switch mechanism.

The switch usually fails because of wear to the vacuum interrupter 14 or some of its attached electrical components. The high-voltage module 10 is then discarded and replaced with a new module. The average useful life of the prior art module is estimated to be in the range of about 60,000 to 125,000 operation cycles. Replacement of the vacuum interrupter modules is quite expensive, especially considering that only one or two of the internal parts have failed.

Another problem with known high voltage modules relates to the dielectric material 42 disposed between the vacuum interrupter 14 and the housing 40. Since the dielectric material is bonded to both components, it is impossible to simply replace the defective vacuum interrupter without damaging the dielectric material. Accordingly, simple replacement of the vacuum interrupter 14 is not possible.

Another drawback with existing high-voltage switches is that the connection between the upper terminal pad 12 and the vacuum interrupter 14 must be provided with as low a resistance connection as possible. The prior art upper terminal pad 12 is typically made of aluminum that over time might develop a highly resistive aluminum oxide layer. Prior to assembly of the switch, the oxide surface is chemically stripped and an oxide inhibiting grease is applied thereto. The prior art vacuum interrupter module 10 has a copper mounting plate 50 that is mechanically fastened to the aluminum terminal pad with bolts 52. Thus, maintaining a low electrical resistance joint with this design depends on the mechanical connection between the terminal pad and the mounting plate and the effectiveness of the oxide inhibiting grease. Over time, the effectiveness of either feature could be lost, thereby increasing the joint's electrical resistance. This leads to failure of the vacuum interrupter module 10.

Yet another drawback of the original vacuum interrupter module 10 is that a single copper moving stem 32 makes both the electrical and mechanical connections between the pull rod screw to the rest of the switch mechanism. In the vacuum interrupter module 10, a steel pin 56 is inserted through a transverse hole in the copper moving stem and through a slotted hole in the pull rod screw 57. The copper moving stem 32 is comparatively softer than the steel pin 56 as a result of annealing during the brazing operations used to fabricate the vacuum interrupter. With the numerous opening and closing operations of the vacuum interrupter, a large amount of force is exerted on the steel pin. These repeated cycles on the pin enlarge the hole in which it is retained, thus changing the dimensions of the connecting pieces. When multiple vacuum interrupter modules are controlled by a single lever mechanism, the moving stem holes enlarge at a different rate. As a result, there is a loss of synchronism between the contacts in each vacuum interrupter module 10 as their respective stem holes deform. Prior art vacuum interrupter modules attempt to counteract this enlarging of the stem hole by locating it tangentially to the attached shunt plate 58. This provides an increased bearing surface on one side of the pin. Alternatively, the module would be cycled through a number of operations prior to synchronizing the switch to cold work and increase the strength of the material surrounding the steel pin 56.

Several drawbacks are evident from this modified shunt plate construction. Welding the shunt plate to the moving stem and maintaining a precise tangential alignment is difficult because the exact location of the shunt plate after welding is controlled by weld shrinkage. Moreover, trying to maintain a consistent weld shrinkage all around the stem so that the shunt plate is simultaneously tangential to the holes on both sides of the stem is extremely difficult and cannot be uniformly achieved.

Thus, the need exists for a refurbished vacuum interrupter module with improved operating characteristics. Additionally, there is a need for a refurbished vacuum interrupter module which can recycle useable parts at a significant savings.

DISCLOSURE OF INVENTION

It is thus an object of the present invention to provide a refurbished high-voltage vacuum interrupter module that salvages some of its original components with minor modifications thereto. Moreover, it is an object of the invention that the refurbished vacuum interrupter module last longer and perform better than the original.

It is another object of the present invention to provide a vacuum interrupter module, as above, which provides a new dielectric potting material bonded to a new vacuum interrupter that significantly reduces the likelihood of electrical flashover. Moreover, it is desirable that the dielectric material be removable from the housing to allow for servicing of internal components of the module in the field.

It is a further object of the present invention to provide a module, as above, wherein the dielectric material is inserted into the housing with a grease which provides further dielectric protection between the housing and the vacuum interrupter module to further reduce the risk of flashover between ends of the interrupter. Use of a grease with dielectric properties fills any interstices between the housing and the potting material to ensure that there are no voids therebetween. This causes any electrical flashovers to occur over the external surfaces of the module housing and further enhances the life thereof.

It is yet another object of the present invention to provide a module, as above, where the electrical connection between an upper terminal pad and a stationary contact of the vacuum interrupter significantly reduces the build up of aluminum oxide therebetween. This is accomplished by employing an aluminum terminal pad welded to a transition piece with a low magnesium—low silicon aluminum welded to the upper terminal pad. A copper bar is then soldered to the transition piece to facilitate the connection therebetween and ensure a low resistance electrical joint.

It is yet another object of the present invention to provide a module, as above, wherein the vacuum interrupter has a moving stem which is connected to a moving assembly. This moving assembly is biased to a lower terminal pad through a flexible shunt mechanism taken from the original high-voltage vacuum interrupter module. The new moving assembly includes a copper outer sleeve that receives a steel inner sleeve. The copper outer sleeve includes a shunt plate at one end which is attached to the previously provided flexible shunt while the other end of the outer sleeve has external threads and longitudinal slits to allow for connection to the moving stem of the new vacuum interrupter. The inner sleeve is received within the outer sleeve and provides a cavity for receipt of an over-travel spring. One end of the inner sleeve has a cross-hole therethrough. The inner sleeve receives a pull rod screw from the original switch assembly and is coupled to the inner sleeve by a crosspin. The inner sleeve axially and slidably receives the pull rod screw which is biased by the over-travel spring at one end and is connected to the pull rod at the opposite end. As in the original switch assembly, the pull rod extends axially through the lower terminal pad and functions to open and close the contacts within the vacuum interrupter through the moving assembly. Such a construction of employing a highly conductive outer sleeve and a high strength inner sleeve separates the mechanical and electrical functions of the connection between the lower terminal pad and the vacuum interrupter. This assembly has been found to be more effective over a long life operation of the vacuum electric switch.

The foregoing and other objects of the present invention, which shall become apparent as the detailed description proceeds, are achieved by a high voltage electric vacuum interrupter module comprising an upper terminal pad, a vacuum interrupter having a stationary stem at one end and a moving stem at an opposite end, the upper terminal pad detachably secured to the stationary stem, a moving end assembly detachably connected to the moving stem, a lower terminal pad detachably connected to the moving end assembly, a housing enclosing the vacuum interrupter and the moving end assembly between the upper and lower terminal pads, and a dielectric material at least partially enclosing and bonded to the vacuum interrupter, the dielectric material and the vacuum interrupter removable as one, without damage thereto, from the housing.

Other aspects of the present invention are attained by a high voltage electric vacuum interrupter module comprising an insulated housing with an opening therethrough and an interior surface, the housing having an upper open end and a lower open end, a conductive upper terminal pad having a downwardly extending bar, the upper terminal pad enclosing the upper open end, a vacuum interrupter having a stationary stem electrically connected to the bar, and a moving stem extending in a direction opposite the stationary stem, a dielectric material permanently bonded to at least a portion of the vacuum interrupter and substantially filling any voids between the vacuum interrupter and the interior surface, the dielectric material and the vacuum interrupter removable from the housing when the upper terminal pad is removed, a moving end assembly connected to the moving stem, the assembly having a highly conductive outer sleeve which receives a high strength inner sleeve having a crosshole therethrough, a flexible shunt assembly connected to the outer sleeve, a conductive lower terminal pad substantially enclosing the lower open end, the lower terminal pad having an opening therethrough, the flexible shunt connected to the lower terminal pad, a pull rod axially extending through the lower terminal pad opening, wherein the pull rod connects to a pull rod screw having a cross-pin slot and is connected to the inner sleeve by a cross-pin received through the cross-hole and the cross-pin slot, and an over-travel spring received within the inner sleeve and biasing the pull rod, wherein axial movement of the pull rod axially moves the moving stem to connect or disconnect with the stationary stem within the vacuum interrupter.

Still another object of the present invention is attained by a method for refurbishing a high voltage electric switch comprising the steps of disconnecting a pull rod from a pull rod screw of a vacuum interrupter contained in one end of the housing, removing an upper terminal pad from an opposite end of a housing, disconnecting a flexible shunt from the shunt plate and removing a lower terminal pad from an opposite end of the housing, cutting dielectric material bonded between an interior of the housing and the vacuum interrupter, removing the vacuum interrupter and attached the shunt plate and any remaining dielectric material from the housing, modifying the upper terminal pad to receive a new vacuum interrupter which has a stationary stem opposite a moving stem, temporarily securing the vacuum interrupter to the upper terminal pad and the upper terminal pad to the housing, depositing potting material between the housing and the vacuum interrupter so that the potting material bonds to the vacuum interrupter but not the housing or the upper terminal pad, removing the vacuum interrupter with attached potting material from the housing and the upper terminal pad, assembling a new moving assembly to the moving stem, assembling the upper terminal pad to the stationary stem and installing the new vacuum interrupter and potting material into the housing, and assembling the lower terminal pad to the new moving assembly and the housing and connecting the pull rod to the moving assembly.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
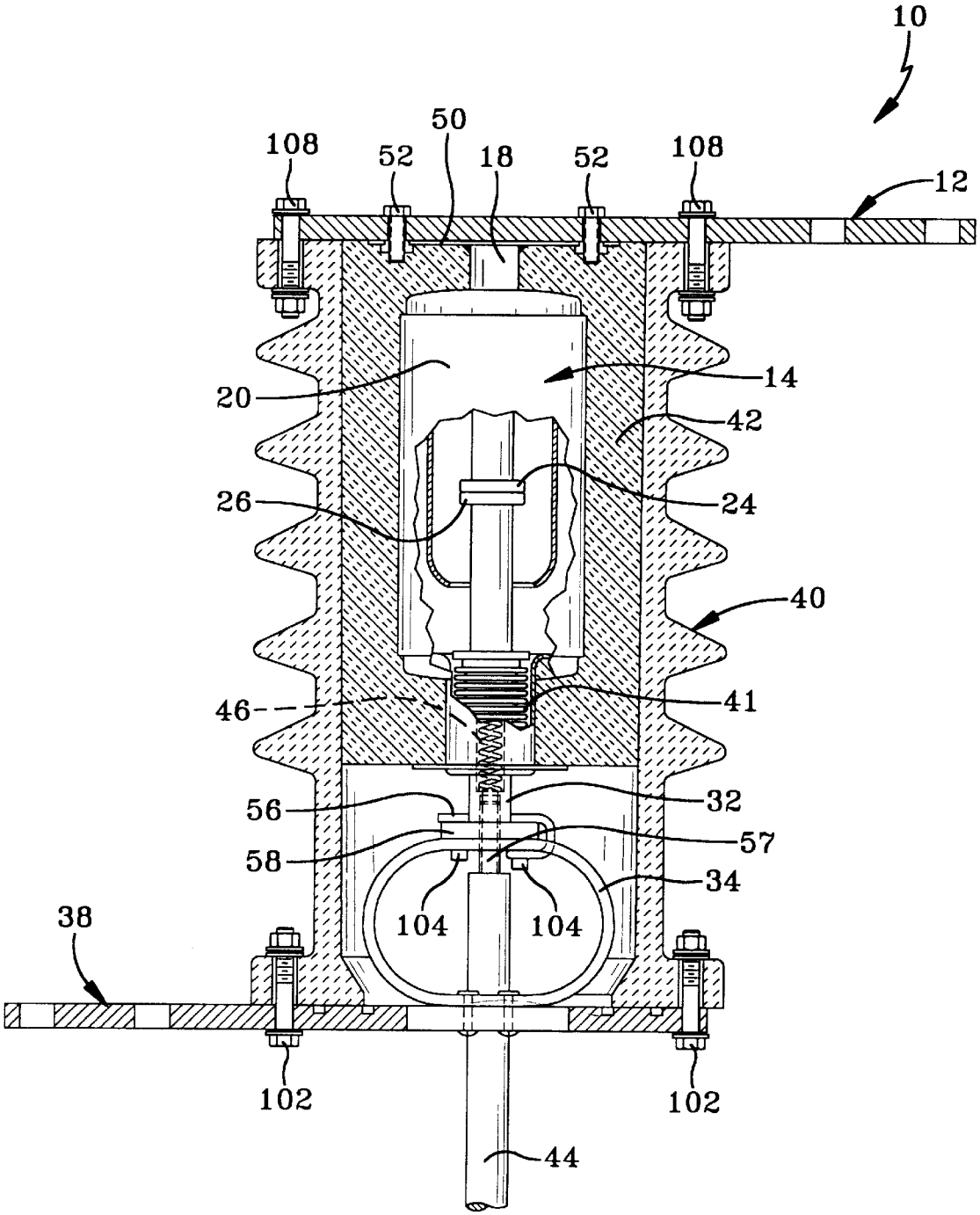
FIG-1 PRIOR ART
FIG. 1 is a cross-sectional view of a prior art high voltage vacuum interrupter module, partially broken away.

A refurbished high voltage vacuum interrupter module made in accordance with the concepts of the present invention is indicated generally by the numeral 100 in the drawings. The module 100 is generally the same construction as module 10, but with significant differences to key components. Generally, the module 100 employs a commercially available off-the-shelf vacuum interrupter. The module disclosed herein is applicable to 400 and 600 ampere modules used on 15, 34, and 46 kV switches. It will be appreciated by those skilled in the art that the methods of remanufacturing the module 100 are equally applicable to higher or lower rated high voltage modules.

The first step in constructing the vacuum interrupter module 100 is to remove the original, presumably now defective, module 10 from the arc furnace or other high voltage switch with appropriate care. The pull rod 44 is removed from the module 10.

Figure 2:
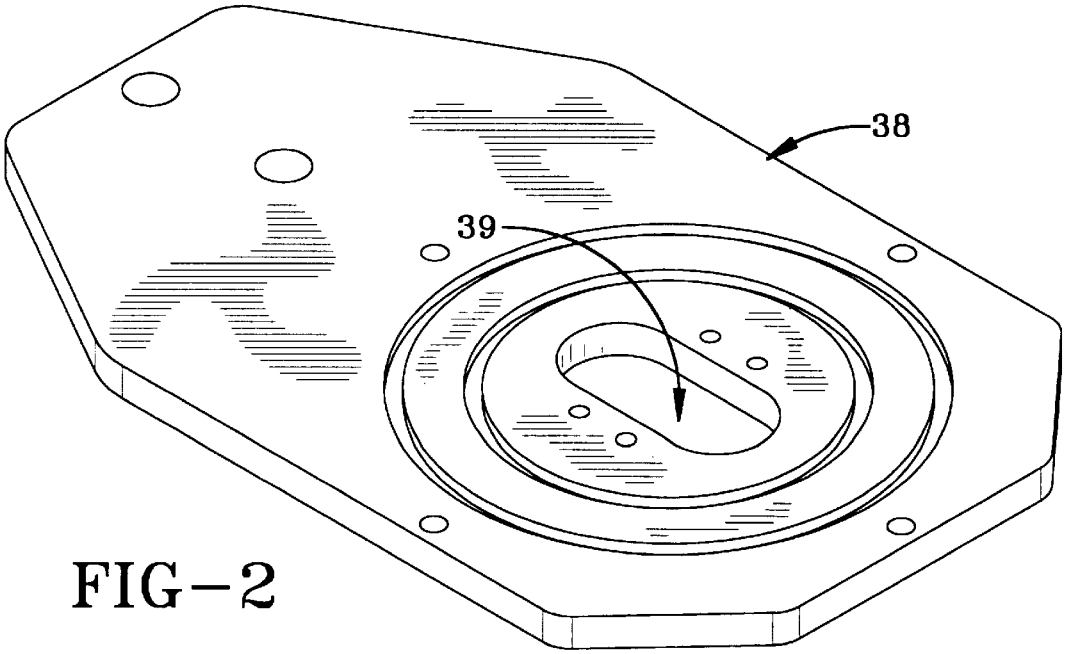
FIG. 2 is a top perspective view of a lower terminal pad.

The defective module 10 is inverted and the bottom terminal pad 38 is removed from the housing 40. This is accomplished by removing the temporary fasteners 102 from the bottom rim of the housing and the terminal pad 38. As seen in FIG. 2, the lower terminal pad has an opening 39 through which the internal components can be accessed. Next, screws 104 are removed from the connection between the flexible shunt 34 and the shunt plate 58. Once these screws are removed, the lower terminal pad 38 with its attached flexible shunt 34 is lifted off of the housing 40.

Referring back to FIG. 1, the assembly is placed right-side up and the four hex-head cap screws 52 are removed from an inner bolt circle of the upper terminal pad 12. Following this, four hex-head cap screws 108 on an outer bolt circle are removed along with associated washers and nuts. The upper terminal pad 12 is then removed from the housing 40, whereupon both terminal pads are cleaned with soap and water.

Using an approximately 18" long electrician's drill bit in a hand drill, a series of holes are axially directed through the foam dielectric material 42 inside the housing 40. This dielectric material is bonded to the interior of the housing and to the vacuum interrupter 20. The holes are drilled through the dielectric material just inside the module housing 40 and extend from the top end of the housing to the open space inside the opposite end of the housing and are approximately parallel with the axis of the housing. Once a sufficient number of holes are directed around the inner circumference of the housing, the vacuum interrupter 14 is cut out and removed. Other methods for removing the vacuum interrupter 14 include using a sandblaster to remove the foam or the use of a drywall or keyhole saw to cut around the vacuum interrupter.

All of the components connected to the moving stem 32 of the vacuum interrupter 14 are removed and retained along with the pull rod screw and the over-travel spring. Of course, if these items are damaged during disassembly or failure of the module 10, they will also need to be replaced.

As will be appreciated by those skilled in the art, it is imperative to maintain a low resistance electrical connection between the terminal pads 12 and 38 so as to diminish internal heat generation and to prolong the life of the module 100 and ensure proper operation thereof. The total electrical resistance from terminal pad to terminal pad must be less than 100 micro-ohms. Accordingly, the electrical connection of a new vacuum interrupter to the upper terminal pad must only be a small fraction of the total resistance. Because of geometric constraints, there is less than 1" of axial length in which to make an electrical connection between the upper terminal pad and a new vacuum interrupter. The upper terminal pad 12 is made of aluminum that naturally forms a highly resistive coating of aluminum oxide. Therefore, any new electrical connection has to break through this oxide layer to make a low resistance connection.

Chemical treatments which strip off the oxide coating, followed by application of an oxide inhibiting grease, were evaluated, but found to be unsuitable because of the hazardous; waste that would be generated by such a process. To ensure a low resistance connection between the upper terminal pad and the stationary stem of a new vacuum interrupter, an investigation of the properties of aluminum was undertaken. The metallurgical properties of the upper terminal pad 12 indicates that it is an aluminum alloy with a silicon content higher than 5% and a magnesium content higher than 1% which is unsuitable for soldering. It is believed that the commonly used aluminum upper terminal pads have an upper limit of magnesium of 1.2%. As such, the magnesium forms a tenacious oxide which inhibits solder flow and wetting.

Figure 3:
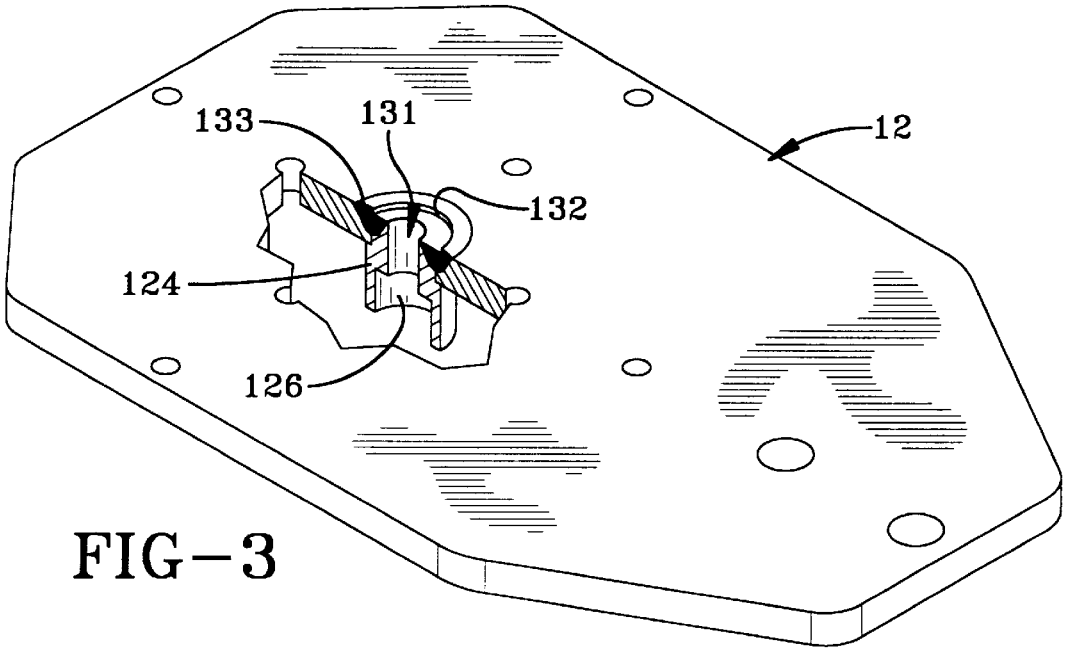
FIG. 3 is a top perspective view of an upper terminal pad, partially broken away, according to the present invention.
Figure 4B:
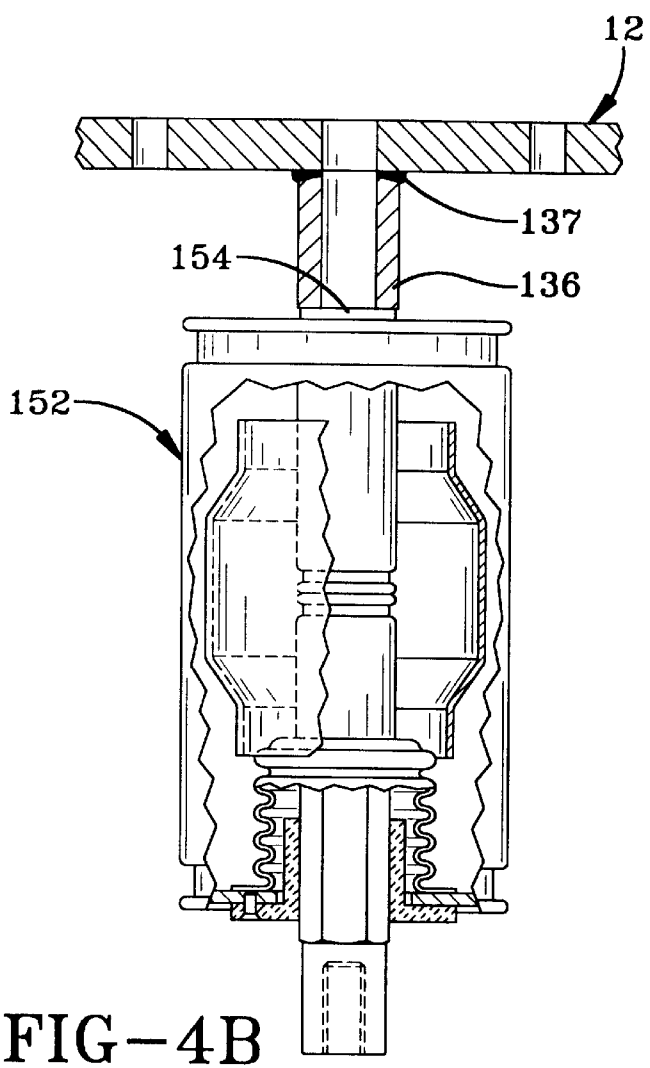
FIG. 4B is a cross-sectional view, partially broken away, of the upper terminal pad connected to the vacuum interrupter by an alternative construction.
Figure 4A:
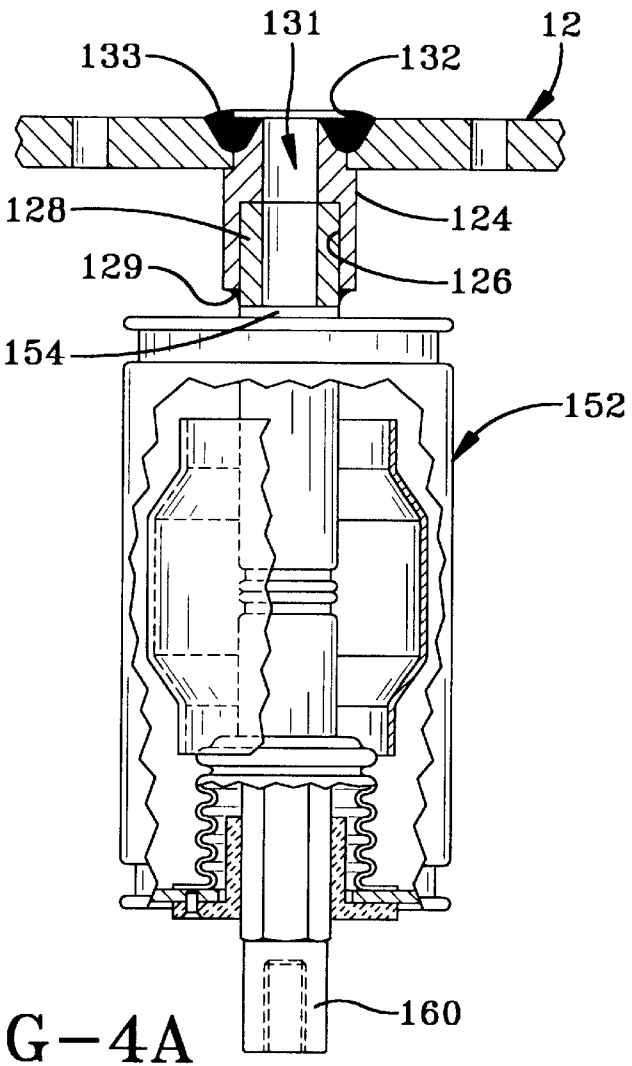
FIG. 4A is a cross-sectional view, partially broken away, of the upper terminal pad connected to a vacuum interrupter.

As best seen in FIGS. 3 and 4A, this obstacle to soldering is overcome by employing a transition piece 124 made of aluminum with low magnesium and silicon content. In the exemplary embodiment, a bar of 2011 aluminum is used for the transitional piece 124. It has no intentional addition of magnesium and the silicon content is 0.4% maximum. Other aluminum alloys such as 6063 aluminum are believed to also be suitable. The transition piece 124 is TIG welded 133 to the terminal pad 12 at the appropriate location and a hole 126 is drilled part way through. Next, a copper bar 128 is soldered to the hole 126 in the aluminum transition piece 124 using an intermediate temperature solder (500–700° F. melting point) whose principle alloys are tin and cadmium in combination with zinc to form a solder connection 129. Or, alternatively, it can be done with a cadmium free tin-zinc alloy having approximately 15% zinc and 85% tin. A reactive flux is used which, upon reaching a specific temperature, penetrates the aluminum oxide and reacts with the underlying aluminum to deposit a layer of zinc. The solder connection 129 is then made between the deposited zinc layer on the aluminum and the readily solderable copper bar 128.

It is the electrical connection between the copper bar 128, the transition piece 124, and the upper terminal pad 12 that creates an electrical connection with no intervening aluminum oxide layers. Since the pieces are all metallurgically bonded together, atmospheric oxygen cannot get to the interfaces and a low resistance connection is assured for the life of the equipment. The space required to assemble these parts is compact and can meet the needed space constraints.

Once the upper terminal pad 12 with attached copper bar 128 is properly cooled, it is mounted in a fixture and a hole 131 is drilled therethrough. A spot face counterbore 132 is then applied to the welded transition piece. Any residual flux left by the soldering operations are removed by a wire brush. To ensure a proper fit, the copper bar 128 is machined to a predetermined height of about 0.9" extending from the surface of the terminal pad.

An alternative process to welding a transition piece and soldering a copper bar to the transition piece is to use friction welding as shown in FIG. 4B. As is well known in the art, friction welding produces a weld under compressive force contact of work pieces rotating or moving relative to one another to produce heat and plastically displace material from the surfaces. In this alternative process, a copper bar 136 is rotated at high speed and pressed against the aluminum terminal pad 12. The friction between the two pieces heats the surfaces to forging temperatures. Accordingly, the parts are forged together and the surface oxides and contaminations are extruded out of the joint. The result is an oxide-free joint 137 between aluminum and copper. After friction welding, the copper boss can be faced off to the desired height. This method of joining is believed to be extremely compact and a- reliable. Moreover, it has the advantage of providing additional space for the use of longer vacuum interrupters with higher external withstand voltages inside the existing housing 40.

Figure 5:
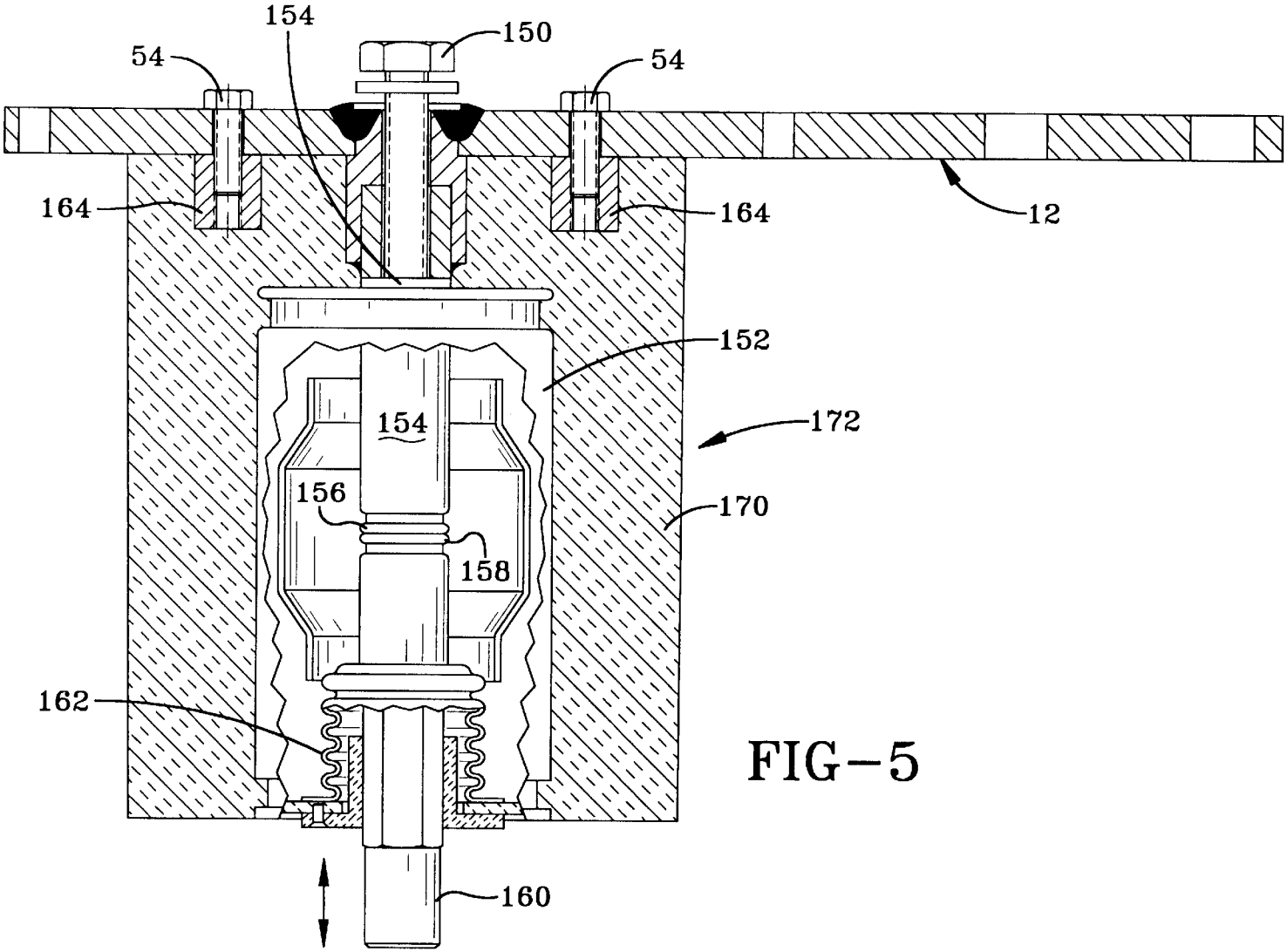
FIG. 5 is a cross-sectional view of a potted vacuum interrupter and attached upper terminal pad according to the present invention.
Figure 6:
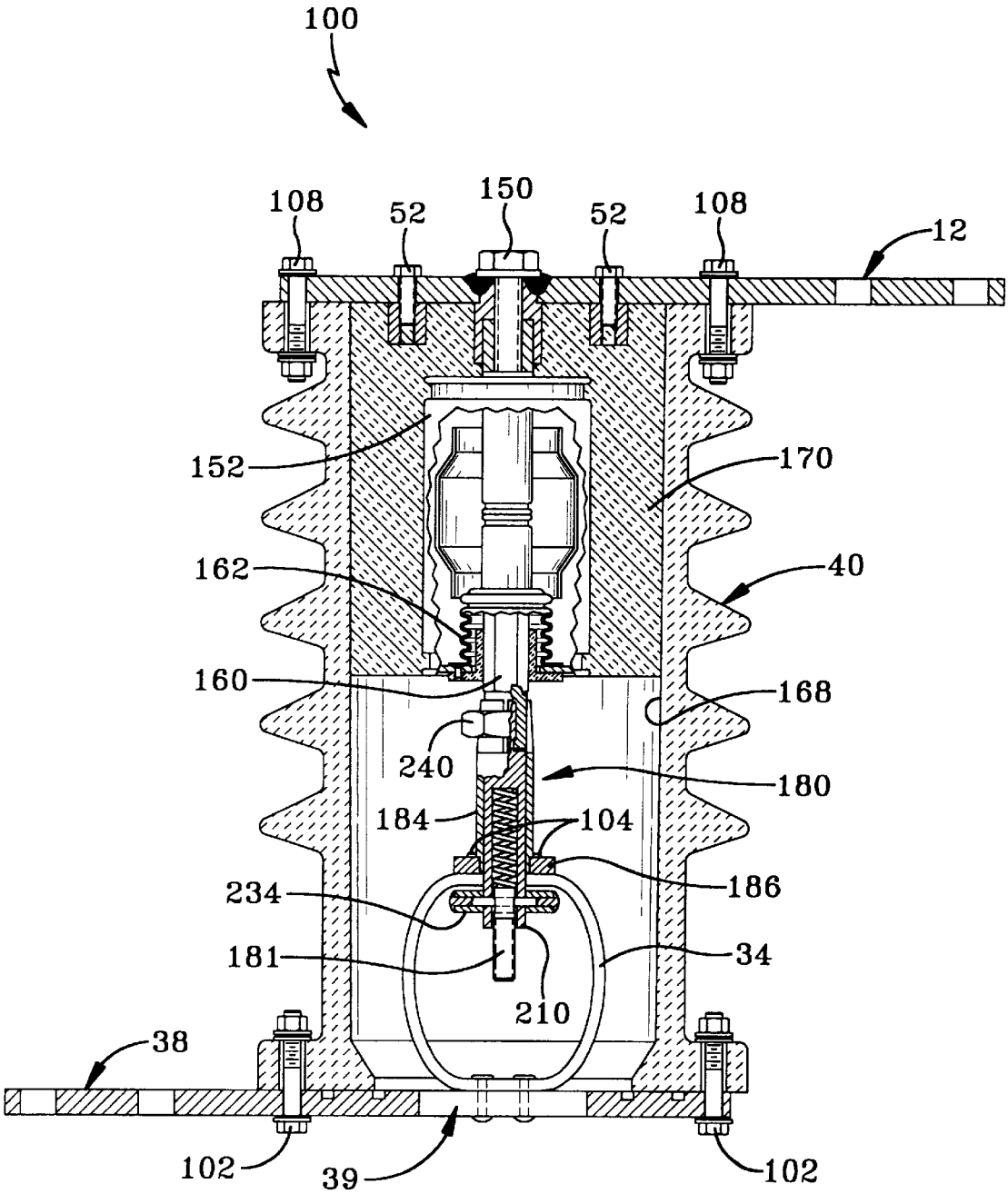
FIG. 6 is a cross-sectional view, partially broken away, of a high voltage vacuum interrupter module according to the present invention.

In any event, upon completion of the refurbished terminal pad 12, a bolt 150 and the appropriate Bellville washers are employed to connect the pad 12 to a new vacuum interrupter 152, as seen in FIGS. 5 and 6. In the preferred embodiment, the vacuum interrupter 152 is supplied by Mitsubishi Electric Corp., part number VVFS-10S6, of Mt. Prospect, Ill.

A bottom section of the bolt 150 is prepared or coated with ND Vibra-Tite Formula #3 thread locker and allowed to dry. The use of this dry thread locker is important because liquid thread lockers tend to migrate into the electrical connection and cause a large increase in the electrical resistance of the joint. The bolt 150 is directed through the hole 131 and is received by the copper stationary stem 154 with the vacuum interrupter 152. The vacuum interrupter 152 is cleaned to remove all grease and dirt from the outer surface thereof. The appropriate surface is then primed with a urethane primer to prepare it for bonding as will be discussed below.

The vacuum interrupter 152 contains many of the same elements as the previous vacuum interrupter; however, new designating numerals are used herein. In particular, a stationary stem 154 extends through the vacuum interrupter housing to a stationary contact 156. A moving contact 158 is mateable with the stationary contact 156. The moving contact 158 is connected to a moving stem 160 extending axially from the other end of the vacuum interrupter via a bellows 162. As such, the moving contact 158 and stationary contact 156 are maintained within a vacuumed environment. The contacts are shown in a closed position. When opened, the moving stem 160 is axially pulled to compress the bellows 160 and move the moving contact 158 away from the stationary contact 156.

In preparing the new vacuum interrupter 152 for use in the module 100, four hex anchors 164 are installed on the inside surface of the upper terminal pad using the bolts 52 around the inner bolt circle. Additionally, an oxide inhibiting grease Noalox is applied to the machined surface of the copper bar 128. Next, the underside of the upper terminal pad 12 and the copper bar is greased with a liberal amount of silicon grease Chemplex 710. The purpose of this grease is to prevent later-applied urethane potting material from bonding to the terminal pad. This is done to allow vacuum interrupter 152 to be removable and replaceable in the module housing 40. After application of the grease, the bolt 150 with the appropriate number of Belleville washers is inserted from the top of the terminal pad through the hole 131 and threaded into the stationary stem 154. The bolt 150 is torqued until the Belleville washers are flat, which occurs at about 250 inch-pounds.

The housing 40 provides an interior surface 168 which is slightly tapered. This surface 168 is cleaned with a wire brush, sandpaper, and soap and water to remove all residual foam and debris. A thin layer of silicon grease, Chemplex 710, is applied to the surface 168, starting from the large open end and extending downwardly a distance of at least 6" into the housing. This dimension is dependent on the axial length of the new vacuum interrupter 152.

With the upper terminal pad 12 attached, the module housing 40 is inverted such that the upper terminal pad is placed down and the housing is open with the vacuum interrupter 152 extending concentrically and axially within the housing.

In order to fit all the components later associated with the vacuum interrupter 152, a commercial vacuum interrupter with a lower voltage rating for the application of the electrical equipment had to be used. As such, the selected vacuum interrupter has only about 3.5" of external flash-over distance. This is the axial distance between the ends of the vacuum interrupter separated by an insulated ceramic cylindrical housing. This is less than the external flash-over distance of the prior art vacuum interrupter. Therefore, the vacuum interrupter must be enclosed with a dielectric material which will increase the dielectric strength of the external surface of the vacuum interrupter 152 so that it exceeds the breakdown voltage of the housing itself which is acknowledged to be about 150 kV BIL (basic insulation level).

A technical concern is the possibility of flashover at the interfaces between the potting material and the vacuum interrupter and also the housing 40. To ensure that an adequate bond between the potting material and the vacuum interrupter is attained, a urethane primer is applied to the vacuum interrupter 152. During the potting process, it is desired that no bond be created between the interior surface 168 and a potting material 170. This is desired so that the potted vacuum interrupter assembly 172 can be removed from the housing 40 to allow for later work thereon or replacement. There is also an electrical requirement that no voids exist between the potting material and the housing which could allow for an arc path. This problem is solved by using a thick silicon grease on the interior surface 168. When a potted vacuum interrupter, generally indicated by the numeral 172, is removed from the housing 40 and reinstalled, both the inside surface 168 of the housing 40 and the external tapered surface of the potted vacuum interrupter 172 are heavily coated with a thick silicon grease. When the potted vacuum interrupter 172 is reinstalled, the pressure extrudes the grease which fills any voids between the module housing and the potting material.

The dielectric potting material 170 is an approximately 70 durometer urethane rubber. It is a two-component material in which the most fluid portion is used in a ratio of 16-to-100 by weight to the most viscous material. The most fluid material is weighed out first and the viscous material is second. The two components are mixed with a paint mixer on a drill so as to minimize entraining air into the mixture in the mixing operation. This mix is then placed in a tank and the tank is evacuated to remove all of the dissolved and entrained air.

Potting of the housing 40 is accomplished by placing it on a level surface with holes cut out for all the bolt heads on the top of the terminal pad. A cup or mask is placed over the exposed end of the vacuum interrupter 152 so as to prevent potting material from getting into the bellows 162. The mixed potting material is then poured between the housing 40 and the vacuum interrupter 152 until the cylindrical ceramic piece of the vacuum interrupter is completely covered. It will be appreciated that potting of the vacuum interrupter is easily accomplished if the potting is done with a housing that has been cut off to the height of the vacuum interrupter. Several hours are required for setting of the potting material. Once this is done, the bolts 108 holding the terminal pad 12 to the housing 40 are removed and the potted vacuum interrupter 172 is pushed out of the housing 40.

Figure 8:
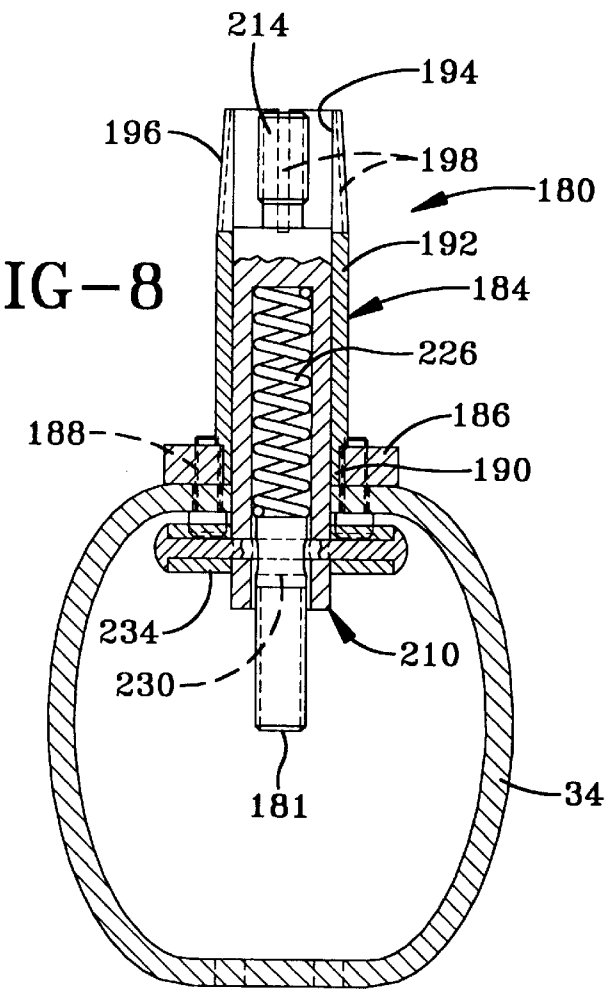
FIG. 8 is a right-side elevational view of the moving assembly shown in FIG. 7.
Figure 7:
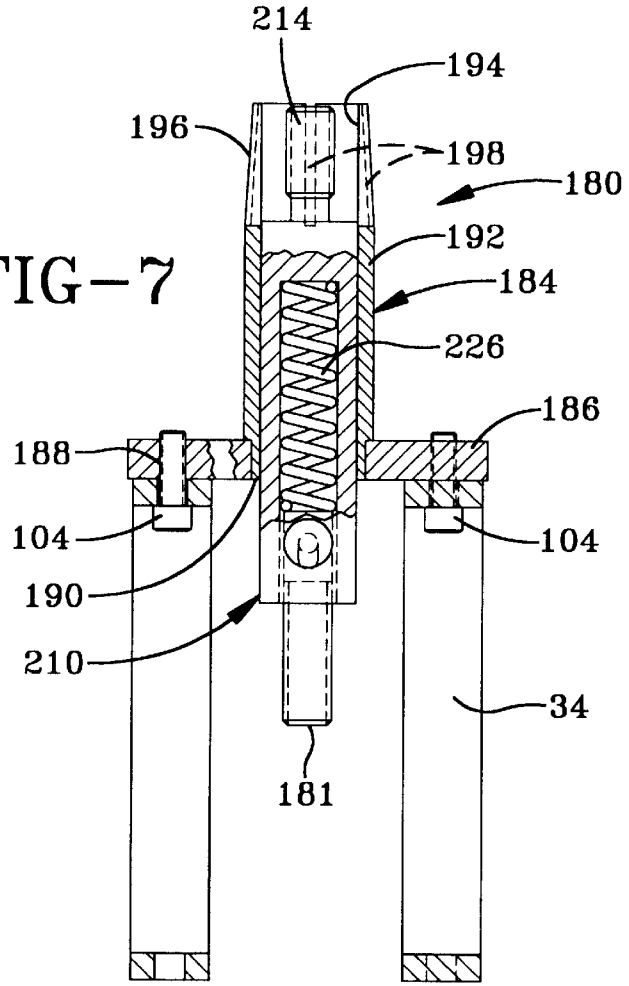
FIG. 7 is an elevational view of a moving assembly with an attached flexible shunt according to the present invention.

Since a vacuum interrupter 152 is different from the one being used in the original equipment, new components are required for the connection between the moving stem 160 and the flexible shunts 34. As best seen in FIGS. 7 and 8, a new moving end assembly is generally indicated by the numeral 180. Electrical and mechanical aspects are important features of the moving end assembly 180. The electrical connection of the assembly 180 must be made between the moving stem 160 and the flexible shunts 34 which are in turn mounted to the lower terminal pad 38. As noted previously, the lower terminal pad 38 and the shunts 34 are reused from the original vacuum interrupter module 10. The mechanical connection must be made between the moving stem 160 and a pull rod screw 181 which is then connected to the pull rod 44. It is also critical for the pull rod screw 181 to be positioned at the same elevation in the housing as in the original vacuum interrupter module 10. In other words, connections to the rebuilt vacuum interrupter module 100 must be dimensionally equivalent to the original module. This is needed so that the contact forces on the rebuilt module 100 are essentially the same and the momentary current required to separate the contacts is unchanged.

These requirements are accomplished by separating the electrical and mechanical functions for the connections between the pull rod 44, the shunts, and the interrupter. Components are specifically designed for each function. The moving end assembly 180 includes a conductive outer sleeve assembly, generally indicated by the numeral 184, preferably made of a high conductive material such as copper. The outer sleeve 184 includes a shunt plate 186 which is made of copper and is rectangularly shaped. The shunt plate includes about four openings 188 provided at each corner thereof for later attachment to the flexible shunt 34. The shunt plate 186 also includes a centrally located bore 190. An appropriately sized copper tube 192 is brazed to and extends from the shunt plate 186. In the preferred embodiment, the tube 192 is a ½" diameter pipe with an extra heavy wall. The tube 192 has an opening 194 aligned with the bore 190. A section of tapered external threads 196 is provided at an end of the tube 192 opposite the shunt plate 186. A plurality of longitudinal slits 198 are also provided along the tube 192 at the external threads 196. Accordingly, the conductive outer sleeve 184 meets the electrical requirements of the vacuum interrupter module 100.

Figure 11:
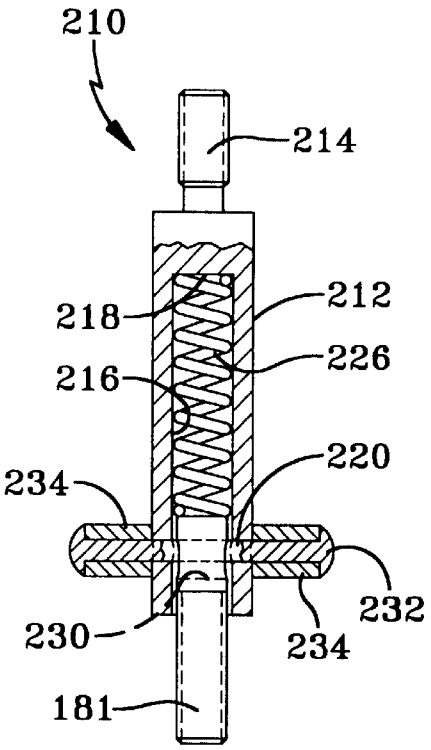
FIG. 11 is a cross-sectional view of the inner sleeve fully assembled to the pull rod screw.
Figure 10:
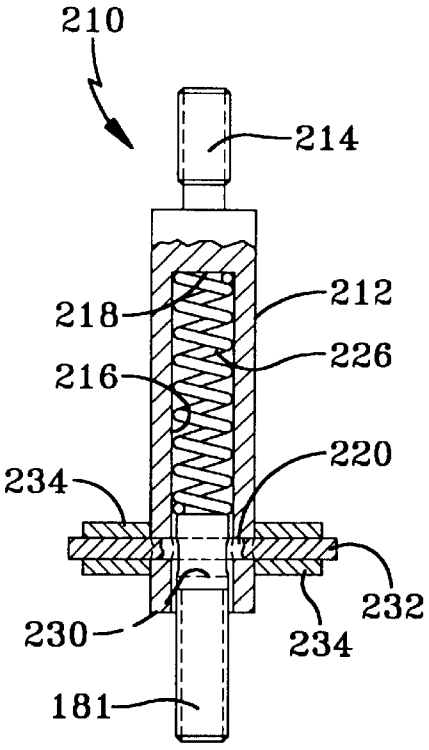
FIG. 10 is a cross-sectional view of the inner sleeve partially assembled to the slotted pull rod screw.
Figure 9:
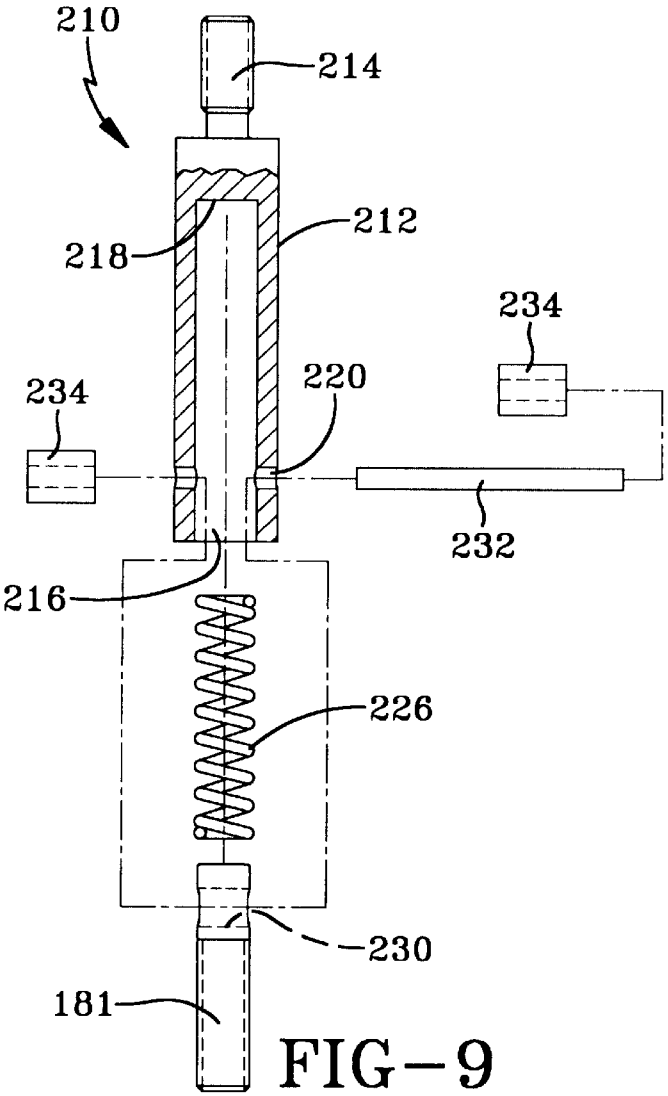
FIG. 9 is an assembly view of an inner sleeve and a pull rod screw utilized in the moving assembly.

The mechanical requirements of the moving end assembly 180 are achieved by the use of a steel inner sleeve assembly generally designated by the numeral 210 and best seen in FIGS. 9–11. The sleeve 210 is received within the opening 194 and the bore 190 of the outer sleeve 184. The inner sleeve 210 includes a shaft 212 from which axially extends a threaded end 214. Opposite the threaded end 214 is a spring cavity 216 which includes a surface 218. Extending transversely through the shaft 212 is a cross-hole 220 which is positioned at about an end opposite the threaded end 214. The inner sleeve assembly 210 is slidably received within the opening 194.

An over-travel spring 226 is received within the spring cavity 216 and is positioned adjacent the bottom 218. The pull rod screw 181 is provided with a cross-slot 230 which is alignable with the cross-hole 220. Upon proper modification of the over-travel spring as discussed hereinbelow, a cross-pin 232 is inserted through the cross-hole 220 and the cross-lot 230 and appropriate bushings 234 are attached to each end of the cross-pin 232.

The use of two different materials, copper for the electrical function as provided by the outer sleeve 184 and steel for the mechanical function as provided by the inner sleeve 210, overcomes a flaw in the original module 10. Use of steel for the mechanical function increases the bearing load which it can support, without deformation, the cross-pin 232. This features makes the synchronization of the module 100 with other modules more stable over its life since the material around the cross-pin hole is much stronger than the original design. As discussed previously, the copper material deformed in the original design and adversely affected the synchronization of the switch.

The vacuum interrupter 152 used in the module 100 has a bellows 162 which is slightly larger than the original bellows 41. As a result, the contact forces generated by the atmospheric air pressure are somewhat higher in the remanufactured module 100 than in the original module 10. This is compensated for by moving the location of the flexible shunt connection to the shunt plate 186 approximately ½" toward the vacuum interrupter 152. The shunts 34 act like springs and this ½" displacement adds a bias force on the moving stem 160 which tends to cancel the increased atmosphere pressure or force on the contacts 156 and 158 in the vacuum interrupter.

In order to ensure that the over-travel spring 226 is adequately prestressed, a standardizing fixture is employed. This fixture consists of a scale for measuring the applied forces and a lever for applying a force to the pull rod 44 as it is assembled to the vacuum interrupter 152. This is done by positioning the upper terminal pad and potted vacuum interrupter 172 assembly on the fixture with the terminal pad sitting on the scale and the shaft 212 facing upwardly. The shaft 212 is screwed into moving stem 160 of the potted vacuum interrupter assembly 172 mounted on the scale. The over-travel spring is inserted into the spring cavity 216. The pull rod screw 181 is then threaded onto the pull rod 44 which then compresses the over-travel spring 226 inside the sleeve. A ⅛" diameter cross-pin 232 which, in the preferred embodiment, is a 2.5" piece of ER70S6 welding wire, is inserted through the cross-pin hole 220 and the cross-slot 230. The force applied to the over-travel spring 226 is measured with the scale. The spring force is adjusted so that it is about 75 pounds just at the point the cross-pin 232 can be slid freely in the cross-hole 220. The spring force is increased by inserting washers into the spring cavity 216 or decreased by grinding the material off of the end of the spring 226. When these forces are properly adjusted, the cross-pin 232 is temporarily secured by pressing two push nuts on each end of the pin. The pull rod 44 is then unbolted from the standardizing fixture and unscrewed from the pull rod screw 181.

The over-travel spring 226 is then secured into place by welding. The bushings 234 which, in the preferred embodiment, are 5/16" diameter and ⅝" long, are made of low carbon steel (not leaded, resulfurized or free machining steel) with ⅛" diameter axial holes therethrough and are used to replace the push nuts. The bushings 234 are slid over the pin 232 and are adjusted so that approximately 3/16" extends from the end of each bushing. The sleeve 210 is clamped in a vice, and the pin is fused first to one and then the other bushing with a TIG welding process. The sleeve is then removed from the vice.

At this time, the assembly 180 is assembled to the moving stem 160. A Belleville washer is installed on the threaded end 214. Next, a wrench is applied to the hex surface on the end of the moving stem 160 to prevent any torque from being applied to the bellows 162 during installation of the assembly 180. Excess torque applied to the bellows would reduce the life of the vacuum interrupter. The steel sleeve 210 is turned to screw its threaded end 214 into the threaded end of the moving stem 160. The bushings 234 are used to turn the assembly 180 and to apply torque to compress the Belleville washer. When the Belleville washer is compressed flat, the cross-pin should be perpendicularly positioned to the length of the upper terminal pad 12. If it is not perpendicular, shims may be placed over the threaded end 214 to adjust the angular location of the bushings 234. Once the correct number of shims are established, the over-travel spring assembly is removed for permanent assembly at a later time.

Prior to final assembly, a modified threaded pipe fitting 240 is screwed on the end of the outer sleeve 184. A Noalox anti-oxidant grease is applied to the inside surface 194, of the conductive sleeve 192 and the outside surface of the moving stem 160. At this time, the threaded end 196 of the sleeve 184 is slipped over the end of the moving stem 160. The conductive sleeve 184 is rotated to align the holes 188 in the shunt plate 186 so that they will be in a proper position to mate with the flexible shunts 34 extending from the lower terminal pad 38.

At this time, the steel inner sleeve 210, with the necessary Belleville washers and shim washers, are installed over the threaded end 214. A wrench is applied to the hex surface of the moving stem 160 to keep from applying torque to the bellows and the vacuum interrupter. The sleeve 210 is then torqued until its Belleville spring washers are flat. The assembly is then turned upside-down and the shunt plate 186 is clamped in a vice. A wrench is applied to the moving stem and the orientation of the upper terminal pad is adjusted so that the length of the terminal pad is perpendicular to the length of the shunt plate 186. A pipe wrench is then used to tighten the modified pipe coupling 240 to the moving assembly 180 until tightly secured to the moving stem 160.

Once this assembly step is completed, a micro-ohm meter is used to test the electrical connection between the conductive sleeve and the moving end of the vacuum interrupter. It has been determined that the resistance between the shunt plate and the connected upper terminal pad should be approximately 60 micro-ohms or less.

Once the moving end assembly 180 is completely assembled to the vacuum interrupter 152, the entire assembly is ready for final assembly. At this time, a thick amount of silicon grease is applied to the entire tapered outside diameter of the potted vacuum interrupter 172. Similarly, a liberal amount of grease is applied to the inside surface 168 of the housing which will interface with the potting material. The housing 40 is turned so that its large open end is up. The greased housing and potted vacuum interrupter are pressed together and the upper terminal pad is rotated to align the bolt holes in the housing and the terminal pad. As the potted vacuum interrupter 172 is inserted into the housing 40, a bead of silicon grease becomes visible on the inside of the module to show that it has been extruded out around the entire diameter of the assembly 172. This is an indication that all voids have been filled between the potting material and the housing. At this time, the necessary bolts, nuts, and washers removed from the original module are reused to fasten the upper terminal pad 12 to the housing 40 and to the potted vacuum interrupter 172. It is recommended that each bolt should have two Belleville washers and one flat washer and that they should be torqued to flatten the Belleville washers.

Figure 12:
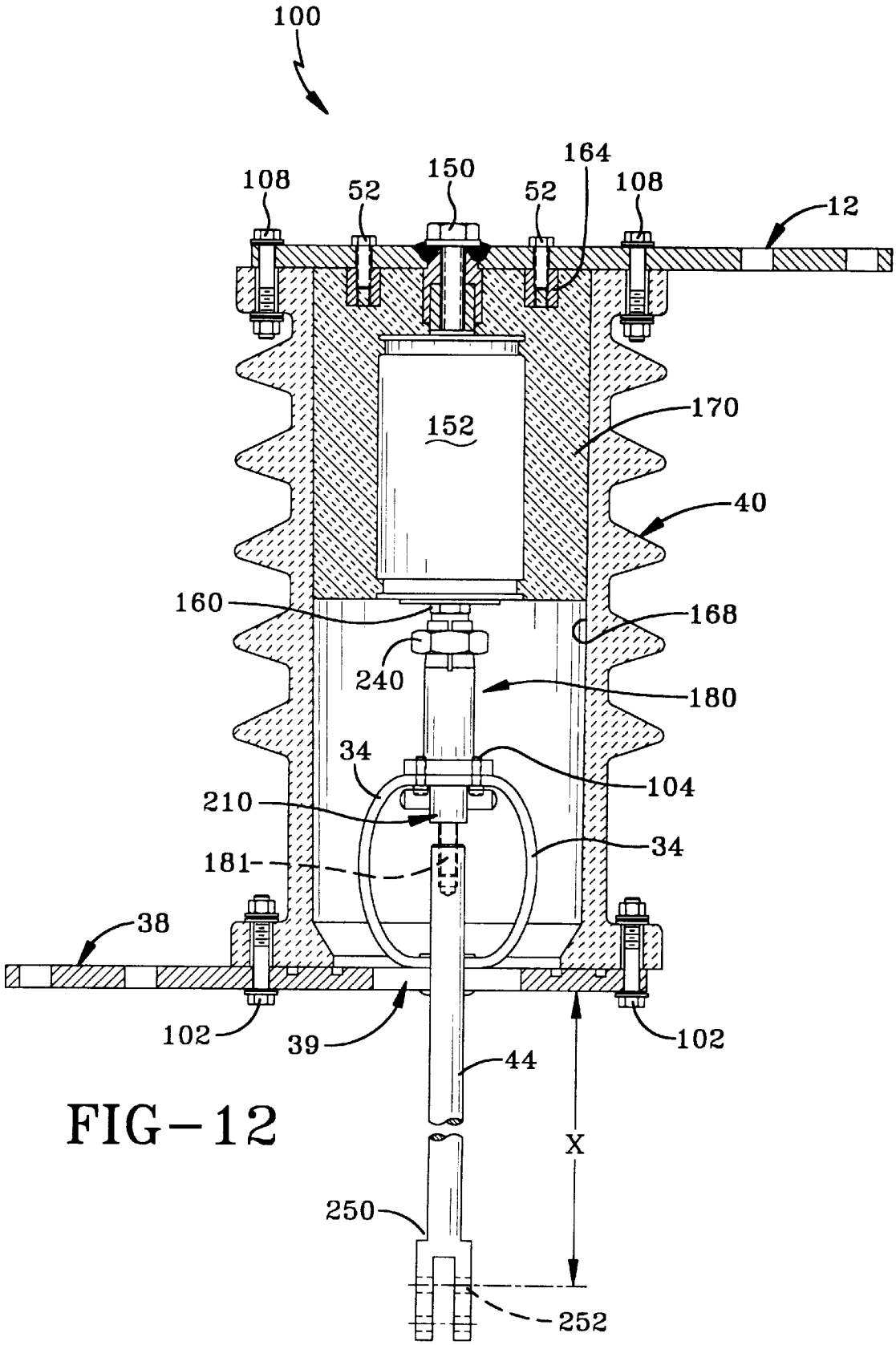
FIG. 12 is a cross-sectional view of the fully assembled high voltage vacuum interrupter module according to the present invention.

As best seen in FIG. 12, the assembly is reinverted to assemble the lower terminal pad 38 and attached flexible shunt 34 assembly to the housing 40. The shunts 34 are squeezed to reduce their widths so that they will fit through the housing opening. The terminal pad 38 is rotated to orient the cap screws 104 with the corresponding holes 188 in the shunt plate 186. At this point, there are two possible orientations for the lower terminal pad with respect to the upper terminal pad and it must be selected based upon the final installation requirement of the assembled switch. The flexible shunt 34 is attached to the shunt plate 186. And, finally, the lower terminal pad 36 is fastened to the housing 40 with bolts 1. 02. Bolts 102 are only temporary until the module is installed on the switch.

Testing of the completed module 100 is determined by the height of the holes in the pull rod over the lower terminal pad. This height is checked with the module up-side-down. The pull rod 44 is screwed onto the pin 181 until it stops. It is then backed off until a flat surface of a pull rod clevis 250 is perpendicular to the length of the terminal pad 38. At this point, the height of a lower clevis hole 252 in the 15 kV pull rod should be between 12.971" and 13.241" as indicated by the dimension line x. The height of the lower clevis hole in the 34 kV pull rod should be between 17.49 and 17.200". It is important to note that the important dimensions in determining this height are the location of the end of the pull rod screw 181, location of the cross-pin 232 in the assembly 180, and the length of the pull rod 44. When the pull rod is screwed all the way in, the pull rod assembly 44 seats on one end of the slotted pull rod screw 181, thus establishing the height of the pull rod clevis hole. The completed switch is placed on the standardizing fixture and the pull rod 44 is installed. A force of 75 pounds is applied to the over-travel spring and the resistance is measured from one terminal pad to the other. The resistance should be less than 100 micro-ohms with the preferred measurements being between 50–80 micro-ohms.

The vacuum interrupter contacts 156 and 158 are separated by about 0.160" with a special tool. A 30 kV AC high-pot is connected to the terminals of the vacuum interrupter module. The voltage is slowly increased to 30 kV and held for 15 seconds. The leakage current measured should be less than 1 milliamp on a new vacuum interrupter module. Once the module 100 has completed the electrical tests, the regions of the terminal pads were electrical connections are made in the field are treated with Noalox oxide inhibitor. The film of Noalox is applied to the surface and wire brushed to remove any surface oxides. A protective paper is then applied over the treated area and the switch is ready for use.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A moving end assembly for use in a vacuum interrupter module having a vacuum interrupter, the moving end assembly comprising:

an outer sleeve connectable to the vacuum interrupter, said outer sleeve having a shunt plate attached thereto, said outer sleeve and said shunt plate having an opening therethrough;

an inner sleeve received in said opening, said inner sleeve having a threaded end at one end and an internal spring cavity at an opposite end, said threaded end connectable to the vacuum interrupter;

a pull rod screw slidably received in said spring cavity;

a spring received in said internal spring cavity to bias said pull rod screw; and a flexible shunt connected to said shunt plate.

2. The assembly according to claim 1, wherein said outer sleeve has external threads at an end opposite said shunt plate, said outer sleeve having at least one longitudinal slot;

the assembly further comprising a nut for tightening said outer sleeve onto said vacuum interrupter.

3. The assembly according to claim 2, wherein said outer sleeve and said shunt plate are made of copper, said shunt plate having holes therethrough for receiving fasteners attached to said flexible shunt.

4. A. The module according to claim 1, wherein said inner sleeve has a cross-hole through the opposite end.

5. The module according to claim 4, further comprising:

a pull rod detachably secured to said pull rod screw;

said pull rod screw having a threaded end attached to said pull rod and a cross-slot through an opposite end and alignable with said inner sleeve cross-hole; and a cross pin received through said cross-hole and said cross-slot to secure said pull rod screw to said inner sleeve.

6. The module according to claim 5, wherein said inner sleeve is made of steel.

7. A high voltage vacuum interrupter module receivable in a housing, comprising:

a vacuum interrupter having a stationary stem at one end and a moving stem at an opposite end; and a dielectric material at least partially enclosing and bonded to said vacuum interrupter, said dielectric material and said vacuum interrupter insertable and removable as one, without damage thereto, with respect to the housing.

8. The module according to claim 7, further comprising:

an upper terminal pad detachably secured to said stationary stem.

9. The module according to claim 8, further comprising:

a transition piece welded to said upper terminal pad;

a cylindrical bar connected to said transition piece, said bar and said transition piece having a hole therethrough aligned with said stationary stem; and a fastener received through said hole and connected to said stationary stem for detachably securing said upper terminal pad to said vacuum interrupter.

10. The module according to claim 9, wherein said transition piece is aluminum with minimal magnesium and silicon content suitable for soldering and wherein said cylindrical bar is copper.

11. The module according to claim 9, further comprising:

a cylindrical bar friction welded to said upper terminal pad; and a fastener received through said hole and connected to said stationary stem for detachably securing said upper terminal pad to said vacuum interrupter.

12. The module according to claim 7, further comprising:

dielectric grease disposed about said dielectric material to fill voids between the housing and said dielectric material and facilitate insertion and removal.

* * * * *